US007585170B2

(12) United States Patent
Oga et al.

(10) Patent No.: US 7,585,170 B2
(45) Date of Patent: Sep. 8, 2009

(54) ANIMAL AND VEGETABLE OILS COMBUSTOR

(75) Inventors: Shigeru Oga, Susono (JP); Hiromitsu Iwasaki, Susono (JP); Toshikazu Oga, Sunto-gun (JP); Makoto Oga, Sunto-gun (JP)

(73) Assignees: Yamaichi Metal Co., Ltd., Shizuoka (JP); Yamaichi New Technology Co., Ltd., Shizuoka (JP)

( * ) Notice: Subject to any disclaimer, the term of this patent is extended or adjusted under 35 U.S.C. 154(b) by 575 days.

(21) Appl. No.: 10/534,065

(22) PCT Filed: Mar. 17, 2003

(86) PCT No.: PCT/JP03/03199

§ 371 (c)(1),
(2), (4) Date: May 6, 2005

(87) PCT Pub. No.: WO2004/057235

PCT Pub. Date: Jul. 8, 2004

(65) Prior Publication Data

US 2006/0063118 A1 Mar. 23, 2006

(30) Foreign Application Priority Data

Dec. 19, 2002 (JP) ..... 2002-368297

(51) Int. Cl.
*F23C 1/00* (2006.01)
*F23C 7/00* (2006.01)
*F23C 14/46* (2006.01)

(52) U.S. Cl. ..... 431/185; 431/8; 431/9; 431/187; 431/188

(58) Field of Classification Search ..... 431/185, 431/8, 9, 354, 187, 188
See application file for complete search history.

(56) References Cited

U.S. PATENT DOCUMENTS

| | | | | | |
|---|---|---|---|---|---|
| 4,006,589 | A | * | 2/1977 | Schirmer | 60/748 |
| 4,203,717 | A | * | 5/1980 | Facco et al. | 431/182 |
| 4,473,350 | A | * | 9/1984 | Gitman | 431/160 |
| 4,622,007 | A | * | 11/1986 | Gitman | 432/13 |
| 4,642,047 | A | * | 2/1987 | Gitman | 432/13 |
| 4,672,900 | A | * | 6/1987 | Santalla et al. | 431/9 |
| 4,797,087 | A | * | 1/1989 | Gitman | 431/10 |
| 4,879,959 | A | * | 11/1989 | Korenberg | 110/264 |
| 4,974,780 | A | * | 12/1990 | Nakamura et al. | 239/102.2 |
| 5,062,789 | A | * | 11/1991 | Gitman | 431/9 |
| 5,123,364 | A | * | 6/1992 | Gitman et al. | 110/346 |
| 5,236,350 | A | * | 8/1993 | Cummings et al. | 431/354 |
| 5,346,390 | A | * | 9/1994 | Slavejkov et al. | 431/8 |
| 5,380,194 | A | * | 1/1995 | Polomchak et al. | 431/183 |

(Continued)

FOREIGN PATENT DOCUMENTS

JP U 50-41121 4/1975

(Continued)

*Primary Examiner*—Carl D Price
(74) *Attorney, Agent, or Firm*—Oliff & Berridge, PLC

(57) ABSTRACT

An animal and vegetable oils combustor, wherein primary air is introduced into a burner tile in the form of straight-ahead air flow moving straight ahead along the axial direction of the burner tile and secondary air is introduced in the form of swirl air flow moving along the inner surface of the side wall of the burner tile, whereby perfect combustion is liable to occur since a centrifugal force acts on liquid-drop fuel by swirl air flow to diffuse the fuel in the radial direction and the liquid-drop fuel does not take such a route as to be adhered to the inner wall even if char is included in the liquid drop fuel since the fuel is jetted after the grain size thereof is adjusted to small one beforehand.

7 Claims, 3 Drawing Sheets

U.S. PATENT DOCUMENTS 5,454,712 A * 10/1995 Yap ..... 431/10
5,599,375 A * 2/1997 Gitman ..... 75/10.42
5,944,507 A * 8/1999 Feldermann ..... 431/189

FOREIGN PATENT DOCUMENTS

JP A 56-146913 11/1981
JP U 58-007016 1/1983
JP A 10-026312 1/1998
JP A 11-094229 4/1999
JP A 2002-195536 7/2002
JP 2003-21322 A * 1/2003

* cited by examiner

ANIMAL AND VEGETABLE OILS COMBUSTOR

BACKGROUND OF THE INVENTION

The present invention relates to an oil combustor. More particularly, the present invention relates to a combustor for combusting animal and vegetable oils or waste thereof (referred hereinbelow to animal and vegetable oils).

DESCRIPTION OF THE PRIOR ART

In the prior art, there are no margin to use combustor for heavy oil or kerosene when it is intended to combust animal and vegetable oils.

The combustors of the prior art for combusting heavy oil or kerosene are liable to produce unstable flame, so that the discontinuous combustion and the blow-off phenomenon tend to happen. In order to overcome such problems, a low-speed air current area and a circulating air current area are formed near the nozzle for which fuel spouts out, so that flame is generated and are is mixed to produce an ignition flame. To the ignition flame is added a secondary air (or a diffusion combustion air) to produce combustion (or oxidization) of the fuel.

DISCLOSURE OF THE INVENTION

Animal and vegetable oils are complex mixture which of the primary ingredient is triglyceride obtainable by combining glycerin and fatty acid. Accordingly, the animal and vegetable oils are chemically different from mineral oils, which are of completely refined and separated, liquid hydrocarbons. Further, the animal and vegetable oils are physically different from heavy oil and kerosene oil in that the flash point of the former has higher 370° C. whereas that of the latter has −40° C.~80° C. Accordingly, if the animal and vegetable oils are combusted in conventional combustors for heavy oil or kerosene, there will produce delay in pyrolysis, thus resulting in incomplete combustion phenomena. The incomplete combustion will rise so called pollution problem due to soot, dust, carbon monoxide, and non-combusted droplets. In addition, the delay in pyrolysis will produce a long flame so that only the combustor of a long body furnace can be used.

If a large amount of air is delivered into the furnace to make turbulent diffusion in the combustion atmosphere for the complete combustion, the combustion speed will become slow and the flame will tend to lift. Thus, the stable flame cannot be obtained even if there is provided a flame stabilizer.

Further, if the animal and vegetable oils are atomized with a combustor for heavy oil and kerosene of conventional diffusion range, some part of the droplets atomized are liable to collide with the inner surface of the burner tile of the combustor or boiler adhered thereto. Although volatile components of the adhered droplets will be vaporized, char components thereof will deposit thereon. Thus, if the char deposit progresses, the deposited char will cause the problems of ignition impossibility, unstable flame, production of soot and dust, and occurrence of the vibration. Finally, operation of the combustor in itself will be halted.

There also have the same inconvenience in the fuel-atomizing nozzle and the flame stabilizer provided in the low speed air current area and the circulating air current area.

Nowadays, utilization of the biomass as new energy is required for reducing the amount of carbon dioxide being delivered to the atmosphere. As set forth, there is, however, provide no equipment suitably for combusting animal and vegetable oils as fuel.

The present invention is provided through taking the above-mentioned disadvantages of the combustor of the prior art into consideration. Accordingly, the object of the present invention is to provide a combustor of newly developed arrangement suitable for combusting animal and vegetable oils.

SUMMARY OF THE INVENTION

These and other objects are achieved by a combustor for combusting animal and vegetable oils of a first aspect comprising; a burner tile, a burner nozzle, a means for supplying animal and vegetable oils, through the burner nozzle, into the burner tile in the form of atomized fuel, a means for introducing a straight-line air current into the burner tile, which straightly flows in the vicinity of the burner nozzle toward the opening of the burner tile, and a means for forming the field of centrifugal force surrounding the straight-line air current within the burner tile under the effect of the turning air current, whereby the fuel droplets of the atomized fuel are separated and take various orbits in line with the masses within the field of the centrifugal force and combusted.

There is provided a combustor of a second aspect, in addition to the features of the first aspect, wherein the means for supplying animal and vegetable oils is arranged to deliver the atomized fuel toward the axially central area of the turning air current.

There is provided a combustor of a third aspect, in addition to the features of the first or second aspect, further comprising a means for adjusting the mass of the fuel droplets to be atomized, whereby the delivered and separated by the central force effect, atomized fuel are prevented from contacting with the inner surface of the burner tile.

There is provided a combustor of a fourth aspect, in addition to the features of any one of the first to third aspects, wherein the burner tile is of a cylindrical configuration.

There is provided a combustor of a fifth aspect, in addition to the features of any one of the first to fourth aspects, further comprising a means for adjusting the position of the ignition flame in the central area of the burner tile.

There is provided a combustor of a seventh aspect, in addition to the features of any one of the first to fifth aspects, further comprising a means for adjusting the pressure and the flow rate of the straight-line air current relative to the turning air current.

There is provided a combustor of a eighth aspect, in addition to the features of any one of the first to fifth and seventh aspects, further comprising an ignition burner capable of providing sufficient heat energy for allowing continuous propagation of combustion of the animal and vegetable oils.

BRIEF DESCRIPTION OF THE DRAWINGS

Further feature of the present invention will become apparent to those skilled in the art to which the present invention relates from reading the following specification with reference to the accompanying drawings, wherein.

DETAILED DESCRIPTION OF THE PRESENT INVENTION

Figure 1:
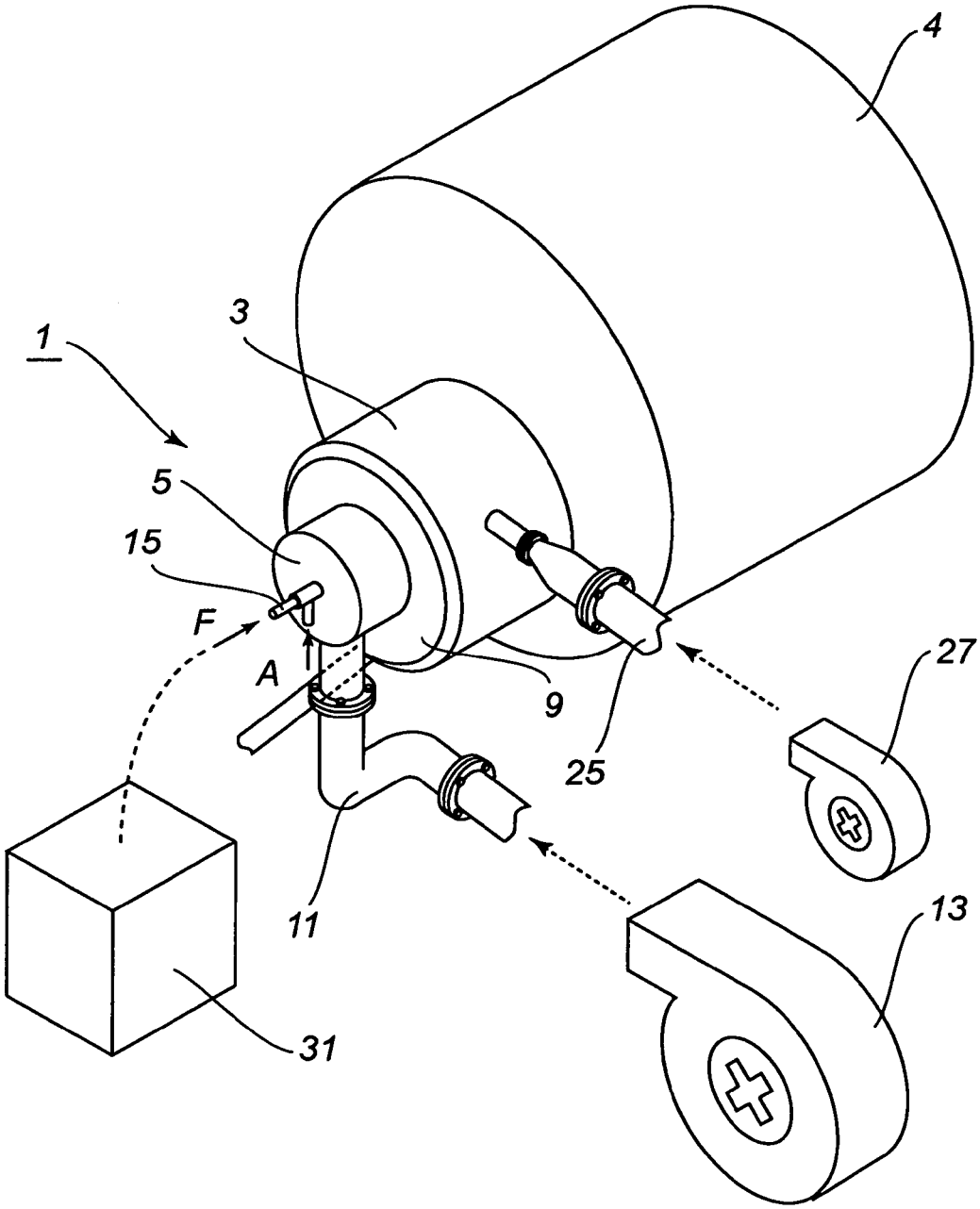
FIG. 1 is a perspective view showing the combustor for combusting animal and vegetable oils of an embodiment of the present invention.
Figure 2A:
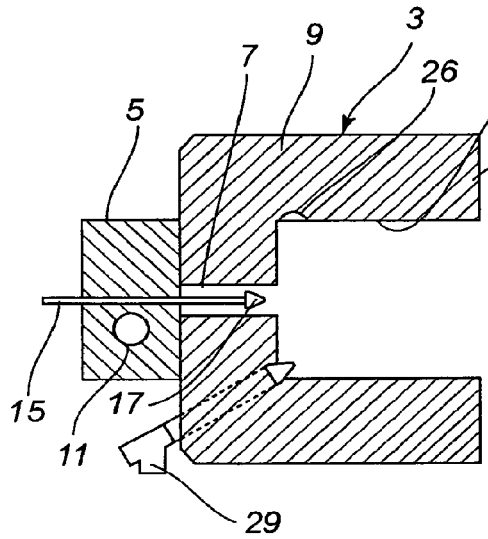
FIGS. 2(*a*) and 2(*b*) are cross-sectional views showing the combustor of FIG. 1.
Figure 2B:
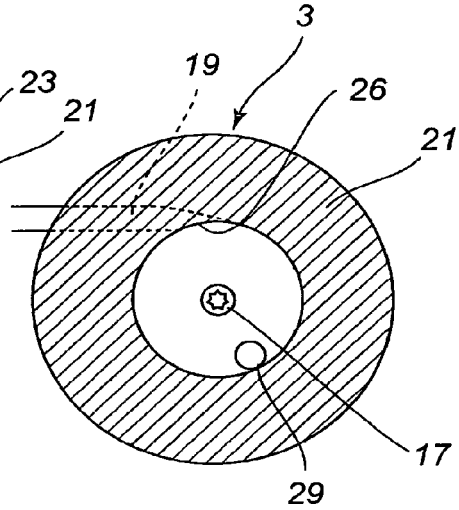

A preferred embodiment of the present invention will now be described with reference to the attached drawings.

The arrangement of equipment for burning an animal and vegetable oils in accordance with an embodiment of the present invention will now be described.

An animal and vegetable oils combustor including a burner tile 3 of a cylindrical shape is designated generally by the reference numeral 1.

The burner tile 3 is connected at its distal opening to a boiler 4, and to the proximal end of the burner tile 3 connected a wind box 5.

A primary air feed passage designated by the reference numeral 7 extends axially through a rear wall 9 of the burner tile 3 at the center thereof. The primary air feed passage 7 is also connected to a wind box 5.

A primary air feed conduit designated by the reference numeral 11 is connected between the wind box 5 and a blower 13.

The primary air feed passage 7, the wind box 5, the primary air feed conduit 11, and the blower 13 together form a means for introducing straight-line air current.

The term "primary air" means an air for ignition.

At the tip of a conduit 15 for fuel delivery is provided a fuel-atomizing nozzle 17. To the conduit 15 are connected a source for supplying fuel (F) or wasted animal and vegetable oils and a source for supplying pressurized air (A). The fuel is shared by a high-speed current of pressurized air and dispersed, or atomized, and thereafter, atomized as atomized fuel (S) from the nozzle 17.

A portion of the conduit 15 and the nozzle 17 are aligned on the axis of the primary air feed passage 7 so that the atomized fuel (S) is atomized into the burner tile 3 while the fuel (S) is being contained within the primary air stream.

In this embodiment, a means for delivering animal and vegetable oils is formed by the conduit 15 and the nozzle 17.

A secondary air feed passage designated by the reference numeral 19 is formed through the sidewall 21 of the burner tile 3. The secondary air feed passage 19 extends perpendicular to the axial direction of the burner tile 3. The opening end 26 of the secondary air feed passage 19 is connected substantially tangential to the inner surface 23 of the sidewall 21 of the burner tile 3. The rear end of the passage 19 is connected to the blower 27 through a secondary air feed conduit 25.

The secondary air feed passage introduces a turning air current into the burner tile 3.

The term "secondary air" means a diffusion combustion air.

A turning air current introducing means is formed by the secondary air feed passage 19 and the blower 27. The secondary air or the turning air current makes a field of centrifugal force into the burner tile 3.

The relative amount and the pressure of the straight-line air current to the turning air current can be controlled by adjusting the primary air introducing means and/or the secondary air introducing means. The adjustment can be done, for example, by controlling the operating condition of the blower 13 and/or blower 27, or by adjusting the cross sectional area of the secondary air feed passage 19 relative to that of the primary air feed passage 7.

An ignition burner designated by the reference numeral 29 is connected to a fuel gas source (not shown) and the air feed source (not shown). The ignition burner 29 is adjusted to provide sufficient heat energy for allowing continuous propagation of combustion of animal and vegetable oil.

An ultrasonic generator designated by the reference numeral 31 generates ultrasonic oscillation, which will reduce the clusters of the fuel (F).

The fuel (F) is adapted to be supplied after being reduced by application of the ultrasonic oscillation. When wasted animal and vegetable oils are used as a fuel in the combustor 1, the oil is emulsified simultaneously with the reduction of clusters, since the waste oils usually contain water.

The ultrasonic generator 31 is of the type disclosed in the Japanese Patent Laid-Open (kokai) public disclosure 2002-195536 (2002), which was previously filed by the applicant of the present invention. The mass or (the size) of the droplets (D) of the fuel (F) delivered after treated by the cluster reduction (or simultaneously with the emulsification) becomes further smaller than that untreated.

The ultrasonic generator 31 and the fuel-atomizing nozzle 17 constitute a means for adjusting the mass or size of the fuel droplets.

The operational principle of the combustor 1 will now be described.

Figure 3:
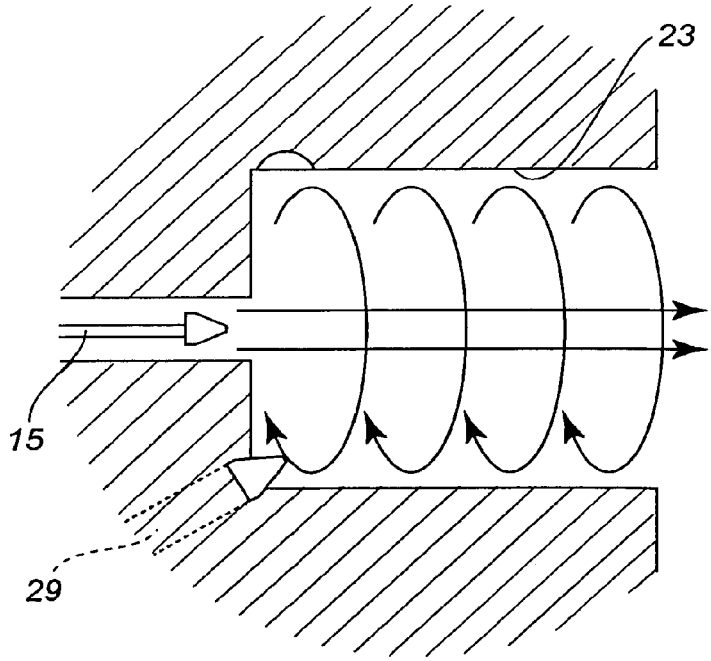
FIG. 3 is a diagrammatic cross sectional view showing the condition of the air current within the burner tile of the combustor of FIG. 1.

The conditions of the air currents within the burner tile 3 are illustrated in FIG. 3.

There exist in the burner tile 3, the turning air current being introduced through the secondary air feed passage 19, and the straight-line air current being introduced through the primary air feed passage 7.

Figure 4:
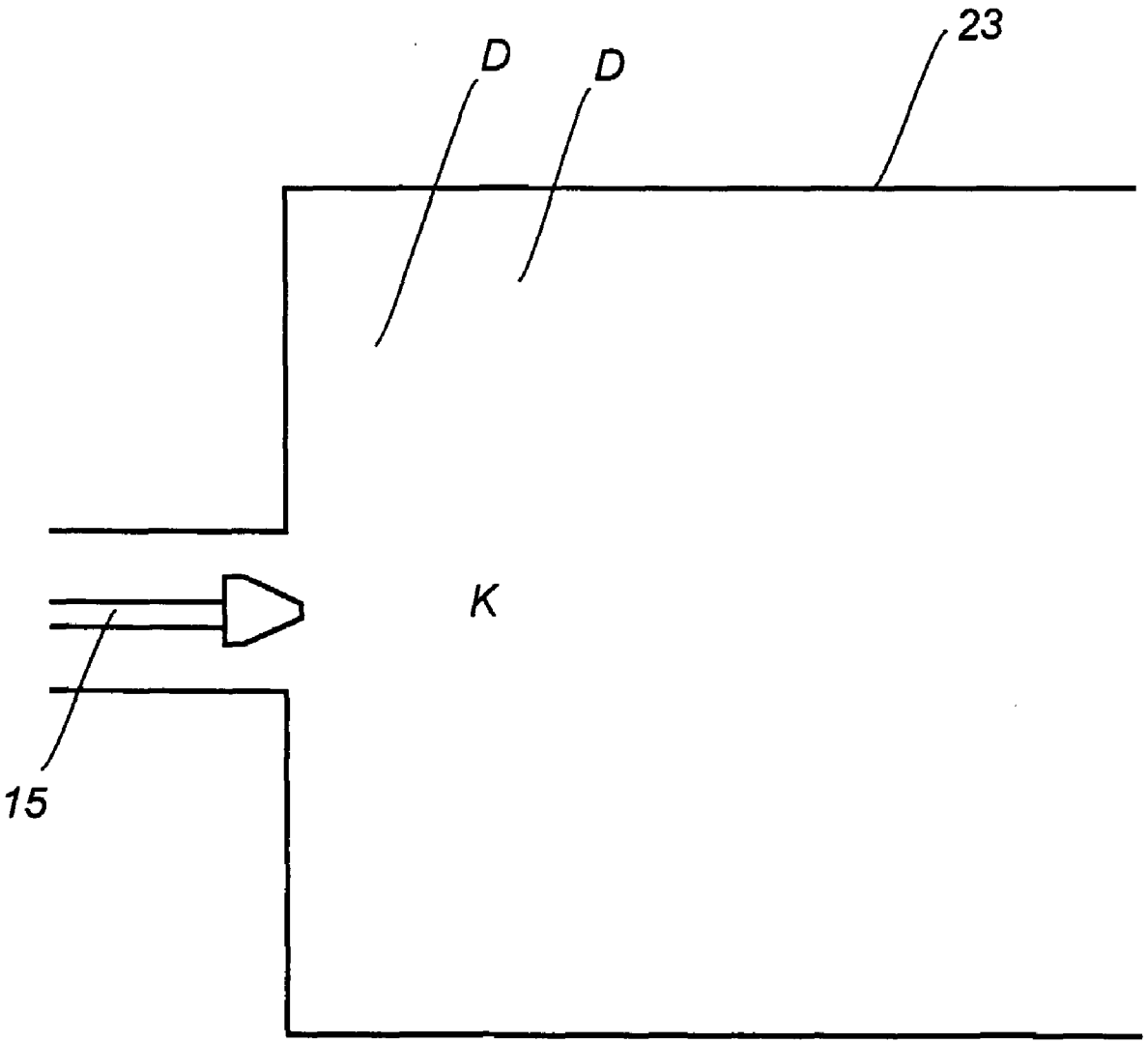
FIG. 4 is a diagrammatic cross sectional view showing the condition of the combustion within the burner tile of the combustor of FIG. 1.

The conditions of the atomized fuel (S) within the turning air current are illustrated in FIG. 4.

The atomized fuel (S) is directed toward the axially central area of the turning air current in the positional relationship of the fuel-atomizing nozzle 17 and the position of the turning air current.

The ignition flame (K) can be formed around the center of the burner tile 3 in the positional relationship of the fuel-atomizing nozzle 17 and the nozzle tip of the ignition burner 29.

The fuel droplets (D), which have been delivered through the fuel-atomizing nozzle 17, are separated from one another and take various orbits in line with the masses by the effect of the centrifugal force, respectively, because the fuel droplets (D) have different masses. The heavier ones follow the outer orbits, whereas the lighter ones follow the inner orbits. Thus, the fuel droplets (D) are dispersed within the interior of the burner tile 3, as can be seen from the cross section of the burner tile 3. This will facilitates the contact opportunity with the air and the combustion of the fuel droplets (D).

Although the heavier droplets follow the outer orbits adjacent to the inner surface 23 of the sidewall 21 of the burner tile 3, they, including heavy char contents, will not contact with the inner surface 23 since the masses (or particle sizes) have already adjusted or reduced upon the supersonic treatment by means of the ultrasonic generator 31.

If the droplet fuel (D), together with air, is completely combusted or oxidized, the fuel (D) will make ignition gases of no mass. The ignition gases are free from the effect of the centrifugal force, sine the gases has no mass. The gases will migrate toward the center of the burner tile 3, and then will be delivered, by the straight-line air current being introduced by the primary air feed passage 7, toward the boiler 4.

The fuel droplets continue to reside within the turning air current until being combusted into ignition gases of no mass. Thus, even if the fuel has a large amount of char contents, thus yielding the delay in pyrolysis, the fuel eventually completely combusted. Further, the combustor 1 does not produce a long flame, since the fuel droplets are adapted to continue to reside within the turning air current. In this connection, a combustor constructed in line with the principle of the present invention can be applied to boilers and the like of shortened body.

The ignition flame (K) exists continuously in stable state and looks floating in no contact with the inner surface 23 of the burner tile 3, because the surrounding turning air current acts as a flame stabilizer.

The method for using the combustor 1 for combusting animal and vegetable oils will now be described.

At first, the primary air and the secondary air are introduced into the burner tile 3 to establish the straight-line air current and the turning air current therein, and then the flame is formed by activation of the igniter burner 29.

Then, the already adjusted, droplet fuel (D) is delivered through the fuel-atomizing nozzle 17 to accomplish stabilized combustion over continuous period in line with the above-described principle.

While the particular embodiment according to the present invention have been illustrated and described, it should be obvious to those skilled in the art that various changes and modifications can be made without departing from the spirit and scope of the invention.

For example, the combustors for combusting animal and vegetable oils according to the present invention can extend their applications to combustion of mixture of animal and vegetable oils and mineral oil, heavy oil, waste oil, COM, and CWM.

In order to prevent the droplets from contacting with the inner surface 23 of the burner tile 3, or to prevent the outermost orbit of the droplets from crossing with the inner surface 23, there have any further means. For example, it is preferable to reduce the sizes of the droplets of the droplet fuel (D) by shearing through the pressurized air before delivering through the nozzle 17. It is preferable to reduce the sizes of the droplets of the droplet fuel (D) by heating the fuel (D). It is also preferable to adjust the diameter and/or the length of the burner tile 3 relative to a desired ignition amount or output within the burner tile 3.

EXAMPLES

Under the test 1 conditions listed below, over 24 hours, the combustor 1 is operated. At every hour for 24 hours, the smoke concentration of the flue gas from the combustor 1 is detected by means of the Backalack smoke tester (available from Hodaka Co., Ltd.). The result obtained on the combustor 1 is that the smoke concentration of the flue gas was always ranked as the level 1 (excellent, i.e. substantially no smoke) and stable combustion had progressed. Further, there was observed substantially no deposit on the inner wall of the burner tile 3 after completion of the 24-hour test.

| Test 1 | | |
|---|---|---|
| (1) | Composition of waste edible oil as the fuel | about 75% |
| | Wasted vegetable oil (rape seed oil) | |
| | Water | about 15% |
| | Impurities of larger than 1 mm (fats and oils of animal origin, food wastes, carbides, etc.) | about 10% |
| (2) | Temperature of the fuel | 40° C. to 50° C. |

-continued

| Test 1 | | | |
|---|---|---|---|
| (3) | Clusters in the fuel have been reduced and the fuel has been emulsified preliminary by applying supersonic energy and mechanical agitation. | | |
| (4) | | Static pressure | Currnet rate |
| | Straight-line air current | 1 kPa | 5 $m^2$/min |
| | Turning air current | 7 kPa | 9 $m^2$/min |
| | Within the boiler 4 | 7-9 kPa | 10-12 $m^2$/min |
| (5) | Size of the burner tile 3 | | |
| | Diameter: | | 280 mm |
| | Length: | | 350 mm |
| (6) | Ignition burner 29 | | |
| | Butane gas: | | 100,000 kcal |

INDUSTRIAL APPLICABILITY

The following advantages can be obtained through the combustor for combusting animal and vegetable oils of the present invention.

(1) Complete combustion can be affected, (2) No long flame is produced, (3) Produced ignition flame is stabilized, and (4) No char is deposited on the inner wall of the burner tile and/or the fuel-atomizing nozzle disposed within the burner tile.

Thus, the combustor of the present invention can be used for combusting animal and vegetable oils (and the waste thereof).

What is claimed is:

1. A combustor for combusting animal and vegetable oils, the combustor comprising;

a burner tile having a first end and a second end opposite the first end, a burner nozzle, means for supplying animal and vegetable oils through the burner nozzle, into the burner tile in the form of atomized fuel, means for introducing a straight-line air current into the burner tile, which straightly flows in a vicinity of the burner nozzle from the first end to the second end of the burner tile at which there is an opening of the burner tile by operation of a blower, the straight-line air current flowing straightly through a central portion of the burner tile from the first end to the second end such that the straight-line air current extends through an entire region through which combustion occurs, and means for forming a field of centrifugal force surrounding the straight-line air current within the burner tile by the effect of a turning air current, which is introduced into the burner tile from an opening end connected substantially tangential to an inner surface of a sidewall of the burner tile by operation of another blower, fuel droplets of the atomized fuel being separated, taking various orbits in line with respective masses of the fuel droplets within the field of the centrifugal force, and being combusted.

2. The combustor according to claim 1, wherein the means for supplying animal and vegetable oils is arranged to deliver the atomized fuel toward an axially central area of the turning air current.

3. The combustor according to claim 1, further comprising means for adjusting a mass of the fuel droplets to be atomized, whereby through interaction between the straight-line current and the turning air current, the atomized fuel is prevented from contacting with an inner surface of the burner tile.

4. The combustor according to claim 1, wherein the burner tile is of a cylindrical configuration.

5. The combustor according to claim 1, further comprising means for adjusting a position of an ignition flame in a central area of the burner tile.

6. The combustor according to claim 1, further comprising means for adjusting a pressure and a flow rate of the straight-line air current relative to the turning air current.

7. The combustor according to claim 1, further comprising an ignition burner capable of providing sufficient heat energy for allowing continuous propagation of combustion of the animal and vegetable oils.

* * * * *